US005701561A

United States Patent [19]

Speckhard

[11] Patent Number: 5,701,561

[45] Date of Patent: Dec. 23, 1997

[54] METHOD AND APPARATUS FOR APPLYING LIQUID TONER TO A PRINT MEDIUM USING MULTIPLE TONER APPLICATORS FOR EACH LIQUID TONER

[75] Inventor: Thomas A. Speckhard, Cottage Grove, Minn.

[73] Assignee: Minnesota Mining And Manufacturing Company, St. Paul, Minn.

[21] Appl. No.: 533,914

[22] Filed: Sep. 26, 1995

[51] Int. Cl.[6] ..... G03G 15/01; G03G 15/10

[52] U.S. Cl. ..... 399/233; 399/241; 399/247

[58] Field of Search ..... 355/256, 326 R; 118/645, 661, 647; 347/115; 399/233, 237, 246, 247, 241

[56] References Cited

U.S. PATENT DOCUMENTS

| | | | |
|---|---|---|---|
| 3,654,896 | 4/1972 | Marx et al. | 118/50 |
| 3,921,580 | 11/1975 | Kase | 118/637 |
| 3,927,409 | 12/1975 | Kase et al. | 346/74 ES |
| 3,937,177 | 2/1976 | Lloyd | 118/50 |
| 3,952,702 | 4/1976 | Levy | 118/637 |
| 4,141,317 | 2/1979 | Lakhani | 118/661 |
| 4,161,141 | 7/1979 | Lakhani | 118/647 X |
| 4,198,923 | 4/1980 | Blumenthal | 118/660 |
| 4,634,252 | 1/1987 | Jeremijevic | 354/324 |
| 4,648,704 | 3/1987 | O'Leary | 355/10 |
| 4,734,788 | 3/1988 | Emmett et al. | 358/300 |
| 4,804,979 | 2/1989 | Kamas et al. | 346/157 |
| 5,109,794 | 5/1992 | Komatsu et al. | 118/660 |
| 5,124,730 | 6/1992 | Lewicki, Jr. et al. | 346/153.1 |
| 5,126,769 | 6/1992 | Lewicki, Jr. et al. | 346/153.1 |
| 5,155,528 | 10/1992 | Morishige et al. | 355/208 |
| 5,374,980 | 12/1994 | Kubo et al. | 355/256 |
| 5,420,673 | 5/1995 | Itoh | 355/256 |

FOREIGN PATENT DOCUMENTS

| | | | |
|---|---|---|---|
| 0 306 217 A2 | 3/1989 | European Pat. Off. . | |
| 3-23480 | 1/1991 | Japan | 355/256 |
| 1182702 | 3/1970 | United Kingdom . | |
| 1456381 | 11/1976 | United Kingdom | 355/256 |

OTHER PUBLICATIONS

"Electrography", *Nonimpact Printing*, No. 54, 5 pages.

"3.6 LaserScribe 8413 Laser Printer", *Courtesy Data Recording Systems, Inc.*, Nonimpact Printing, 1 page. (no date).

*Primary Examiner*—Joan H. Pendegrass

*Attorney, Agent, or Firm*—Gary L. Griswold; Walter N. Kirn; John H. Hornickel

[57] ABSTRACT

A toner station for use in single-pass or multi-pass electrostatic printers includes two or more toner applicators for each color, thereby increasing the printing speed without degrading print quality.

6 Claims, 3 Drawing Sheets

METHOD AND APPARATUS FOR APPLYING LIQUID TONER TO A PRINT MEDIUM USING MULTIPLE TONER APPLICATORS FOR EACH LIQUID TONER

BACKGROUND OF THE INVENTION

The present invention relates to an apparatus for applying toner in a recording apparatus, and more particularly in an electrostatic printing apparatus.

Electrostatic color printers or plotters operate by passing a print medium, e.g., specially-coated paper or plastic film, across one or more charging heads. The charging heads apply a charge to the print medium in the pattern of the desired printed image. Subsequently, a liquid toner is applied to the print medium and the toner adheres to the charged patterns. Excess toner is removed by a vacuum chamber or roller.

Electrostatic printers are constructed in several ways. In a multi-pass system (e.g., an 8900 series electrostatic printer from Xerox Engineering Systems, San Jose, Calif.), a single charging head is used in association with a series of toner stations (typically four for the colors, yellow, cyan, magenta, and black). In the multi-pass system, print medium is transported across the charging head and then one of the toner stations to apply the color toner of that particular station. The print medium is then rewound and passed across the charging head and a different toner station for each color to be applied to the print medium.

Another electrostatic printer is the single-pass printer (e.g., a Scotchprint™ Model 9512 from 3M, St. Paul, Minn.). In the single-pass system, the printer has charging heads associated with each of the toner stations. The print medium is then passed across each pair of charging heads and toner stations to apply all of the colors. Another example of the single-pass system is found in U.S. Pat. No. 4,734, 788.

In both types of electrostatic printers, single-pass and multi-pass, the same basic design criteria apply, including the speed of printing, toner optical density after printing, residual voltage or charge on the print medium, and media compatibility. In the past, electrostatic printers were used primarily in engineering applications where relatively low print speeds were acceptable. However, electrostatic printers are now being used in a wider variety of applications and customers are demanding faster printing speeds, typically measured in inches per second. An increased printing speed impacts the other design criteria, including necessary toner density, residual voltage requirements, and media compatibility.

SUMMARY OF THE INVENTION

According to the present invention, a method is provided for applying liquid toner to a print medium. First, the print medium is passed across a charging head. Next, the print medium is passed across a first toner applicator, applying a first toner to the medium, and passed across a second toner applicator, also applying the first toner to the medium. Additionally, excess toner is removed from the medium. The method also includes passing the medium across a plurality of first and second toner applicator pairs, each pair applying a different toner to the medium. Additionally, the method includes passing the medium across a plurality of charging heads, where the plurality of charging heads are disposed so that the medium passes across one of the charging heads before it passes across one of the toner applicator pairs.

The invention also includes a method for applying toner to a medium, where the medium is passed across a charging head, then passed across a first group of toner applicators, each of the first group of applicators applying a first toner to the medium. Additionally, the medium is passed across a plurality of charging heads and associated groups of toner applicators. The charging heads are disposed so that the medium passes across one of the charging heads before it passes across one of the groups of applicators. Each group of applicators applies a different toner.

Additionally, the invention includes a toner station for use in an electrostatic printer. The toner station includes a first applicator for applying a first toner to the print medium and a second applicator for applying the first toner to the print medium. Additionally, the toner station includes a charging head.

The invention also includes a device for applying toner to print media. The device includes a media inlet and outlet, defining a media path. An electrostatic charging head is disposed on the media path. A toner station is disposed on the media path between the charging head and the media outlet. The toner station includes two or more toner applicators. Additionally, the device includes two or more charging heads and associated toner stations, all disposed on the media path. Each toner station is disposed between an associated charging head and the media outlet.

The invention also includes a single pass electrostatic printer. The printer includes two or more spaced electrostatic charging heads. A plurality of toner applicators are positioned between each pair of consecutive charging heads. Additionally, each of the plurality of applicators applies a different toner.

Advantages of the present invention include the following. The invention provides faster printing. The invention may be implemented in both single-pass and multi-pass electrostatic printer designs. The invention yields a lower residual charge after passing across each toner station, providing improved color fidelity. Implementing the invention requires minimal redesign of existing printers.

Other features and advantages will become apparent from the following description and claims.

DESCRIPTION OF THE EMBODIMENTS

In order to meet the faster printing speed demands of electrostatic printer consumers, all of the design criteria of the printer must be evaluated. For example, increasing the rate of travel of the print medium through the existing multi-pass or single-pass printers without adjusting other printing parameters results in low optical density of toner applied to the print medium and high residual charge after passing across each toner station, i.e., a low quality print image. The low toner optical density produces a weaker than desired color image, negatively affecting the color fidelity of the final print image. The high residual change will cause excess toner deposition when the print medium is passed across another toner station, also negatively affecting the color fidelity of the final print image.

The toner station of the present invention balances the different design criteria, allowing faster printing. The two toner applicators at each toner station allow the charging head voltage to remain at an acceptably high level, while the residual voltage is low enough to prevent excess color deposition. The two-applicator toner station configuration is also superior to single-applicator, slower transport printers. The present invention is applicable to both single-pass and multi-pass printing systems. Generally, the invention is directed to a toner station that includes a toner source, a first toner applicator, a second toner applicator, and a toner remover.

Figure 1:
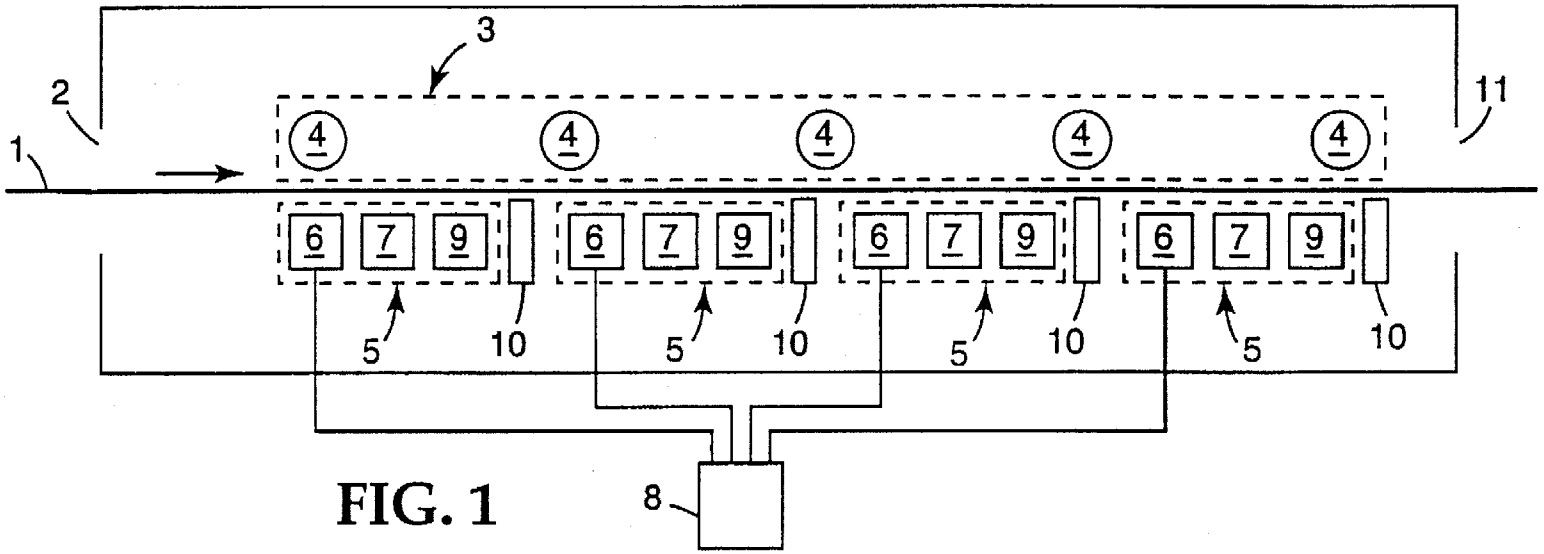
FIG. 1 is a block diagram of a single-pass printer.

FIG. 1 is a block diagram of a single-pass printer. Print medium 1 enters the printer via inlet 2. Print medium 1 is directed through the printer by a transport assembly 3. As shown in FIG. 1, transport assembly 3 typically comprises a series of rollers 4 and associated lateral guides (not shown). The print medium is transported across consecutive printing stations 5. Each printing station includes an electrostatic charging head 6 and toner station 7. In a printer that applies the four basic colors (cyan, magenta, yellow, and black), there are four printing stations 5, each station applying one of the four colors to the print medium.

Each of the charging heads 6 are programmed by controller 8. Controller 8 determines the precise pattern of charge applied by each charging head 6 to the print medium 1.

Each printing station may also include a toner removal device 9, which may include a vacuum system, a scraper, and/or roller. Additionally, a drying assembly 10 may be positioned along the print medium path after each printing station 5. Drying station 10 may include a compressed air or cross-flow fan.

After passing across all of the printing stations, the print medium exits the printer at outlet 11.

Figure 2:
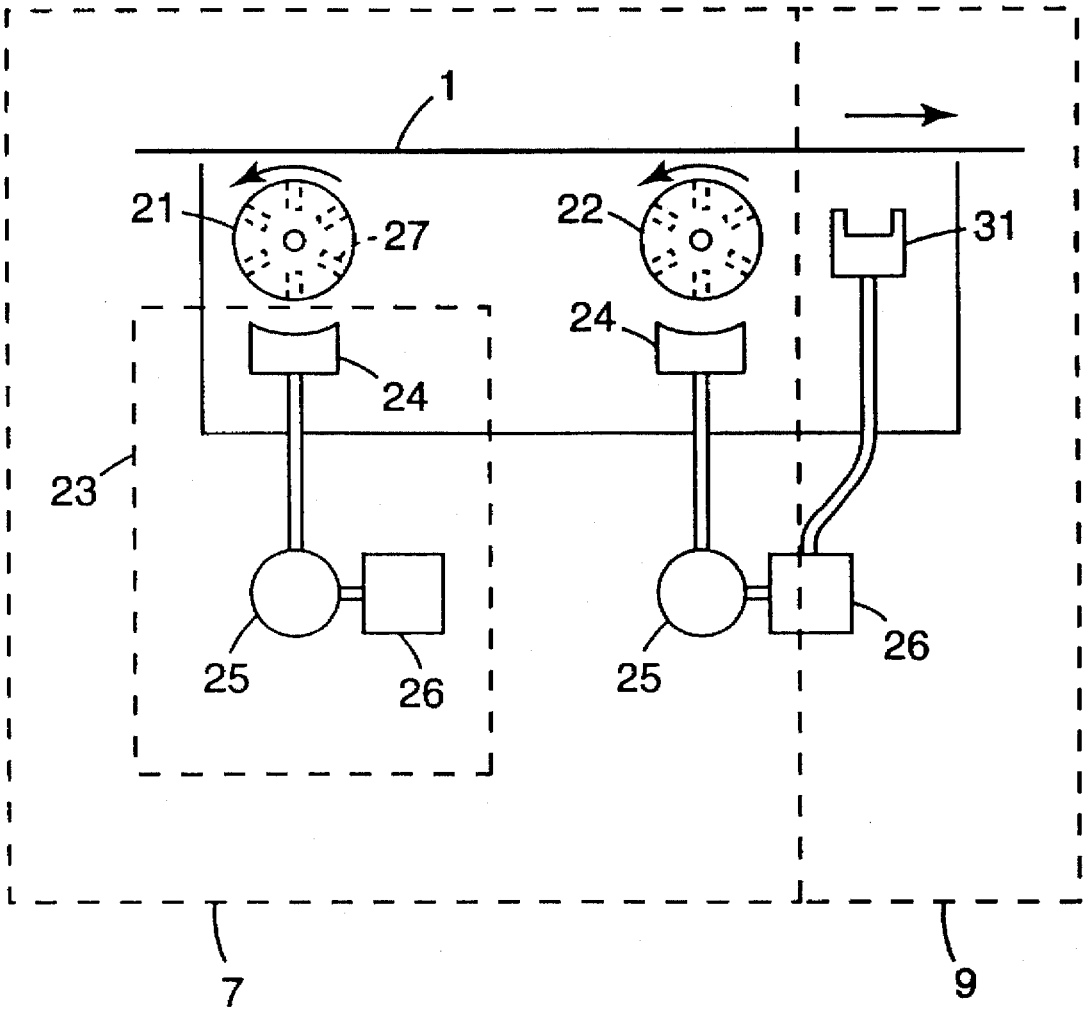
FIG. 2 is a diagram of one embodiment of the toner station and toner remover of the present invention.

Referring to FIG. 2, a block diagram of the toner station 7 and toner remover 9 is provided. Toner station 7 includes two consecutive liquid toner applicators 21, 22 which apply the same toner color. Each toner applicator 21, 22, has an associated liquid toner source 23. The toner source 23 includes a toner fountain 24, toner pump 25, and toner reservoir 26. Examples of liquid toner that may be used with the present invention include Scotchprint™ 8700 and 8800 Series toner, from 3M, St. Paul, Minn.

As shown in FIG. 2, the toner applicators 21, 22 include a plurality of grooves 27 for feeding the toner from fountain 24 along the full width of the applicator 21, 22. The precise size and configuration of the grooves are selected to optimize the application of toner to the print medium 1. As shown in FIG. 2, toner applicators 21, 22 have separate toner sources 23. In other embodiments, a single toner source 23 (fountain/pump/reservoir) is used to provide toner to both toner applicators 21, 22.

Figure 4A:
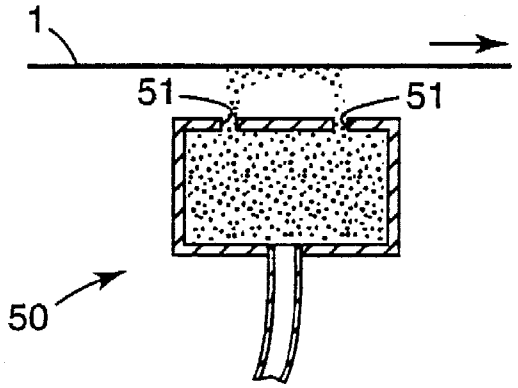
FIGS. 4A and 4B are diagrams of other toner stations of the present invention.
Figure 4B:
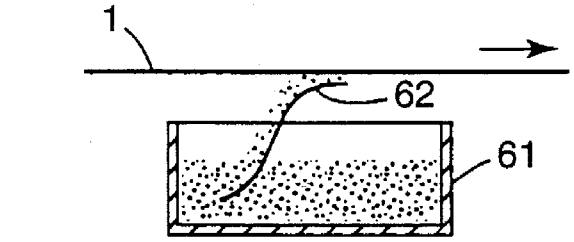
Figure 3:
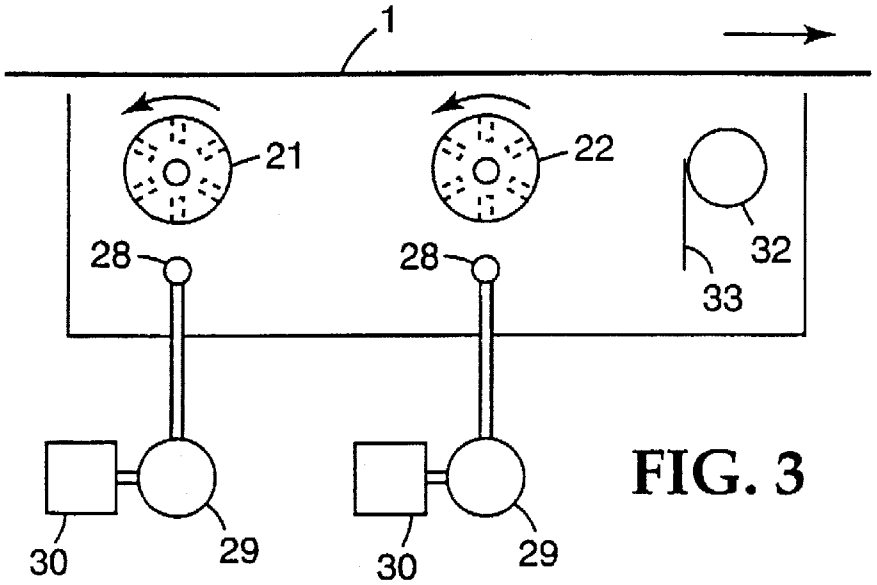
FIG. 3 is a diagram of one embodiment of the toner station and toner remover of the present invention.

As shown in FIG. 3, another embodiment of toner station 7 includes a toner sprayer 28 associated with each applicator 21, 22. Associated with each toner sprayer 28 is a toner pump 29 and toner supply 30. Other toner application techniques may also be incorporated into toner station 7, includes those used in a DCS 5400 from Raster Graphics Inc. (FIG. 4A) and the Xerox Engineering Systems 8900 series (FIG. 4B). In FIG. 4A, toner applicator 50 includes a plurality of openings 51 that direct toner toward print medium 1, creating a "standing wave" of toner through which print medium 1 must pass. In FIG. 4B, toner applicator 60 directs toner from a reservoir 61 along a guide 62 positioned on the print medium 1 travel path.

Positioned downstream (i.e., toward outlet 11) from toner station 7 is the toner remover 9. As shown in FIG. 2, toner remover 9 may include a vacuum system 31 that is associated with a toner supply 23. As shown in FIG. 3, the toner remover 9 may include a roller 32 and/or scraper blade 33.

Figure 5:
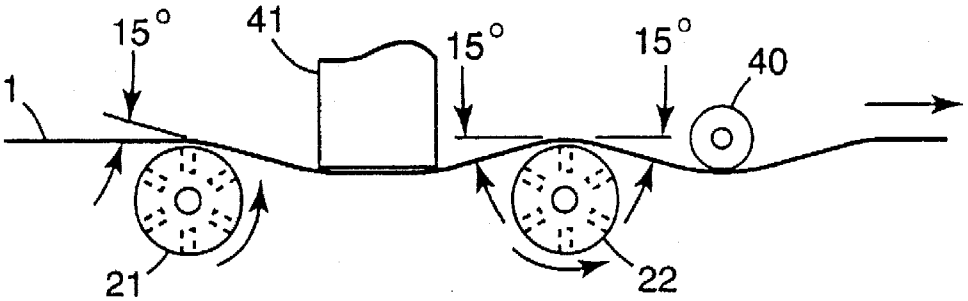
FIG. 5 is a diagram of one embodiment of the toner station of the present invention.

As shown in FIG. 5, roller 40 positioned downstream from the second applicator 22 in a toner station 7 serves not only to transport print medium 1 as part of transport assembly 3, but also serves to maximize the application of toner to the print medium 1. Roller 40 orients the print medium 1 adjacent applicator 22, creating a wrap angle. The wrap angle is selected to increase the application of the toner to the print medium 1, without creating excessive drag on the print medium 1 as it passes through the printer. A wrap angle of about 15 degrees meets these criteria. Also, an additional roller or bias bar 41 may be positioned between the first and second applicators 21, 22, creating additional wrap angles, e.g., about 15 degrees. Other combinations of biasing rollers, bars, and wrap angles may also be used.

Figure 6:
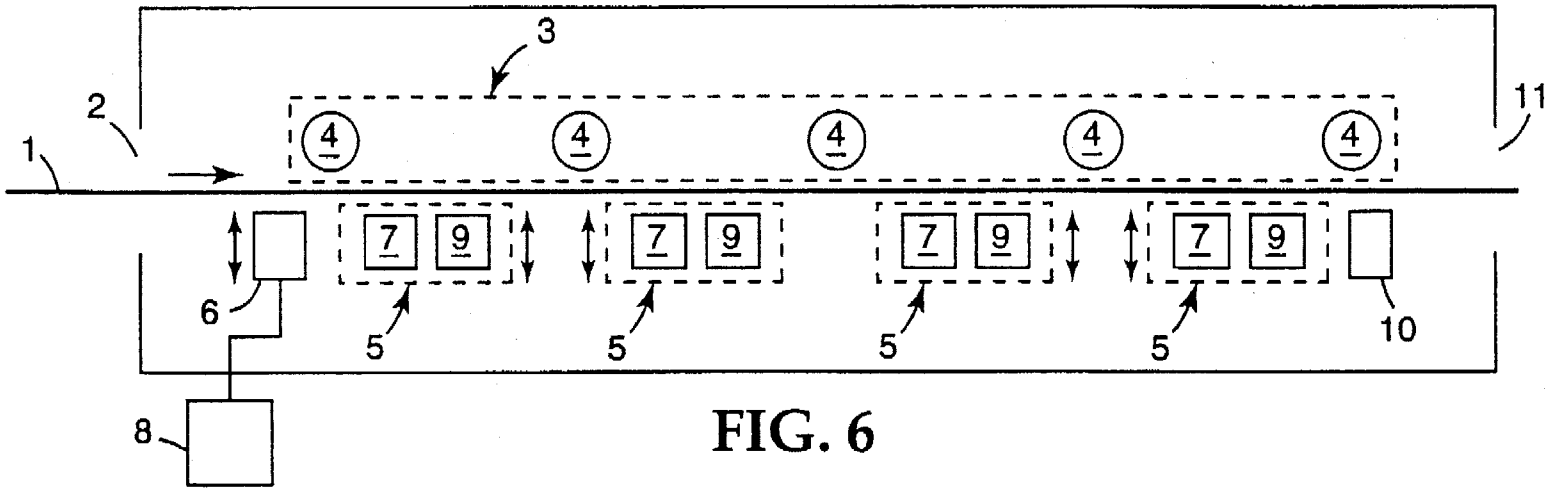
FIG. 6 is a block diagram of a multi-pass printer.

The present invention may also be implemented in a multi-pass printing system as shown in FIG. 6. Once again, print medium 1 enters the printer via inlet 2. Transport assembly 3 moves the print medium through the printer. A single charging head 6 is positioned upstream from the printing stations 5. Transport assembly 3 moves the print medium 1 across the charging head 6, then one of the printing stations 5 to apply the toner color of that station, and the drying assembly 10. Transport assembly 3 then directs print medium 1 back across charging head 6, then across another printing station 5 and drying assembly 10 until all colors have been applied to print medium 1.

Typically, charging head 6 and printing stations 5 are retractable as shown by the arrows in FIG. 6. The printing stations 5 remain in the lower position until the toner color of a station is to be deposited on medium 1, then that station is moved upward toward print medium 1. When subsequent charges are to be applied to print medium 1, charging head 6 is lowered and print medium 1 is directed upstream of charging head 6. Charging head 6 is then raised and the desired charge is applied to print medium 1 as it moves downstream, across charging head 6.

The printing stations 5 of the multi-pass printer include a toner station 7 and toner remover 9 as described above for the single-pass printer. Also, a single drying assembly 10 is typically positioned after the last printing station.

Other embodiments are within the scope of the following claims.

What is claimed is:

1. A method for applying toner to a medium, comprising:

passing the medium across a charging head;

passing the medium across a first toner applicator, applying a toner to the medium;

passing the medium across a second toner applicator, applying the toner to the medium;

passing the medium across a plurality of first and second toner applicator pairs, each pair applying a different toner to the medium; and passing the medium across a plurality of charging heads, the plurality of charging heads disposed so that the medium passes across one of the plurality of charging beads before it passes across one of the plurality of toner applicator pairs;

wherein the plurality of toner applicator pairs allow voltage of each charging head to remain at an acceptably high level during a desired printing speed, while residual voltage is low enough to prevent excess color deposition affecting final print image.

2. The method of claim 1, further comprising removing excess toner from the medium.

3. A method for applying toner to a medium, comprising:

passing the medium across a charging head;

passing the medium across a first group of toner applicators, each of the first group of applicators applying a toner to the medium; and passing the medium across a plurality of charging heads and associated groups of toner applicators, the charging heads disposed so that the medium passes across one of the charging heads before it passes across one of the groups of applicators, wherein each group of applicators applies a different toner; and wherein the plurality of toner applicator pairs allow voltage of each charging head to remain at an acceptably high level during a desired printing speed, while residual voltage is low enough to prevent excess color deposition affecting final print image.

4. A device for applying toner to a single surface of media, comprising:

a media inlet and media outlet, defining a media path from the inlet to the outlet;

a plurality of electrostatic charging heads disposed on the media path to charge the single surface of media; and one loner station disposed on the media path between each charging head and the media outlet, each toner station comprising a plurality of toner applicators that provide liquid toner to the single surface of the media wherein each toner station applies a different toner;

wherein each toning station having the plurality of toner applicator pairs allows voltage of each charging head to remain at an acceptably high level during a desired printing speed while residual voltage is low enough to prevent excess color deposition affecting final print image.

5. A single-pass electrostatic printer, having a plurality of spaced, electrostatic charging heads, comprising:

a plurality of toner applicators positioned between each pair of consecutive charging head;

wherein the plurality of toner applicators allows voltage of each charging head to remain at an acceptably high level during a desired printing speed, while residual voltage is low enough to prevent excess color deposition affecting final print image.

6. The printer of claim 5, wherein each of the plurality of applicators applies a different toner.

* * * * *

UNITED STATES PATENT AND TRADEMARK OFFICE

CERTIFICATE OF CORRECTION

PATENT NO.: 5,701,561

DATED: December 23, 1997

INVENTOR(S): Thomas A. Speckhard

It is certified that error appears in the above-identified patent and that said Letters Patent is hereby corrected as shown below:

Column 4, line 66, "beads" should read –heads—

Column 6, line 3, " loner" should read –toner--

Signed and Sealed this

Seventh Day of April, 1998

Bruce Lehman

*Attest:*

BRUCE LEHMAN

*Attesting Officer*

*Commissioner of Patents and Trademarks*